US005301471A

United States Patent [19]

Fisher et al.

[11] Patent Number: 5,301,471

[45] Date of Patent: Apr. 12, 1994

[54] PORTABLE AIR ANGLE HEAD RANDOM ORBITAL UNIT

[75] Inventors: Steven M. Fisher, Los Angeles, Calif.; Thomas Sato, Midoriko, Japan

[73] Assignee: Fisher Tool Co., Inc., Los Angeles, Calif.

[21] Appl. No.: 76,020

[22] Filed: Jun. 11, 1993

[51] Int. Cl.[5] ..... B24B 23/04

[52] U.S. Cl. ..... 51/170 MT; 15/97.1; 51/134.5 F

[58] Field of Search ..... 51/170 R, 170 MT, 170 T, 51/174, 177, 180, 134.5 F; 15/97.1, 49.1, 28, 50.1, 98

[56] References Cited

U.S. PATENT DOCUMENTS 3,885,355 5/1975 Kakimoto ..... 51/134.5 F
4,516,358 5/1985 Marton et al. ..... 51/170 MT
4,854,085 8/1989 Huber ..... 51/170 MT
5,061,090 10/1991 Kriaski et al. ..... 51/170 MT
5,088,242 2/1992 Lubbering et al. ..... 51/170 T

FOREIGN PATENT DOCUMENTS 2700241 7/1978 Fed. Rep. of Germany ..... 51/170 MT

*Primary Examiner*—Roscoe V. Parker
*Attorney, Agent, or Firm*—Thomas I. Rozsa; Tony D. Chen

[57] ABSTRACT

The present disclosure is a portable air angle head random orbital unit. It provides a novel random orbital collect unit for the spin unit of the portable air angle head random orbital unit. A sander, polisher or eraser head can be attached to the portable air angle head random orbital unit and rotates in a unique random orbital rotation.

29 Claims, 3 Drawing Sheets

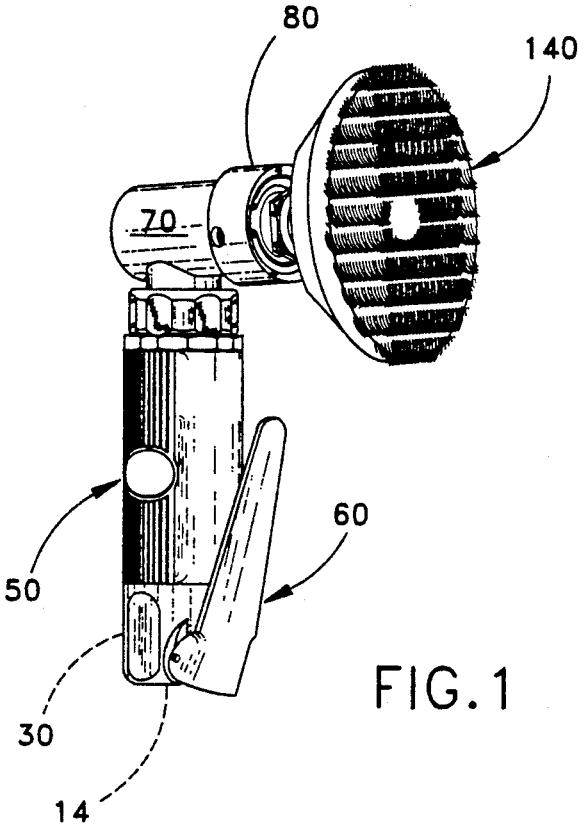
FIG. 1
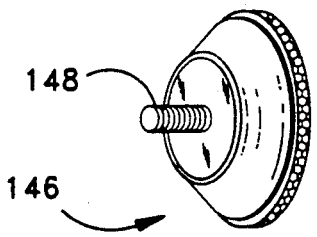
FIG. 8
FIG. 3
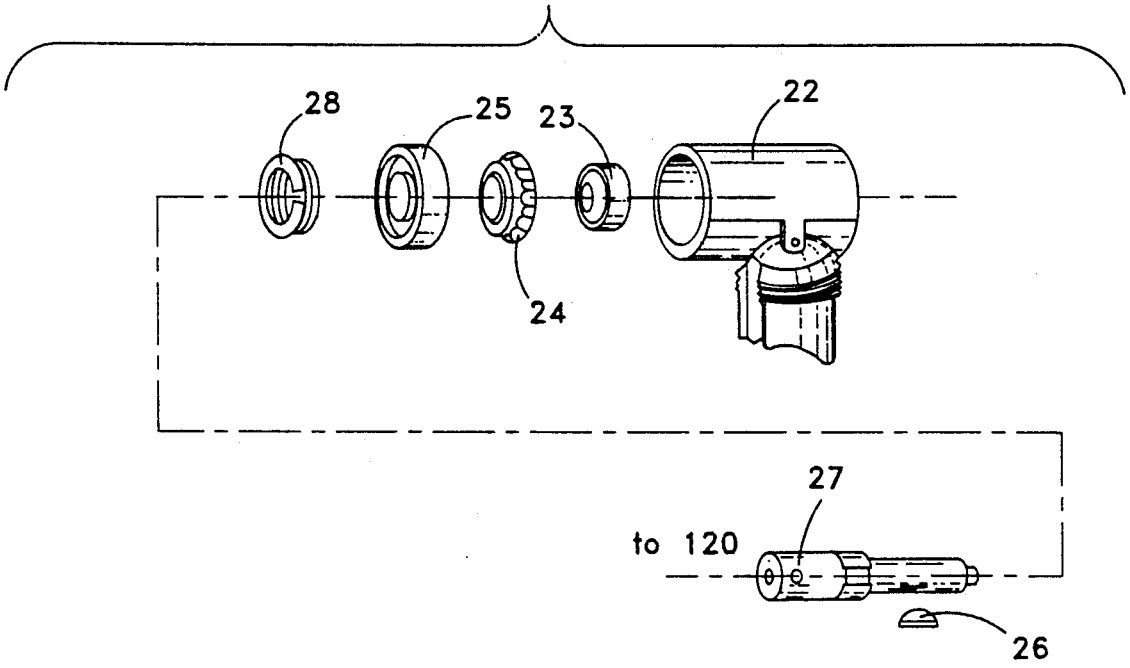

FIG.4
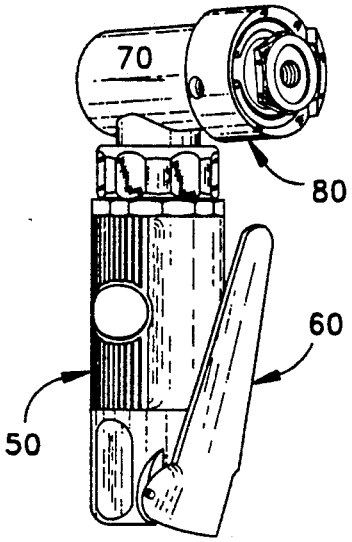
FIG.6
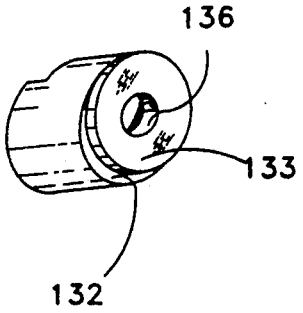
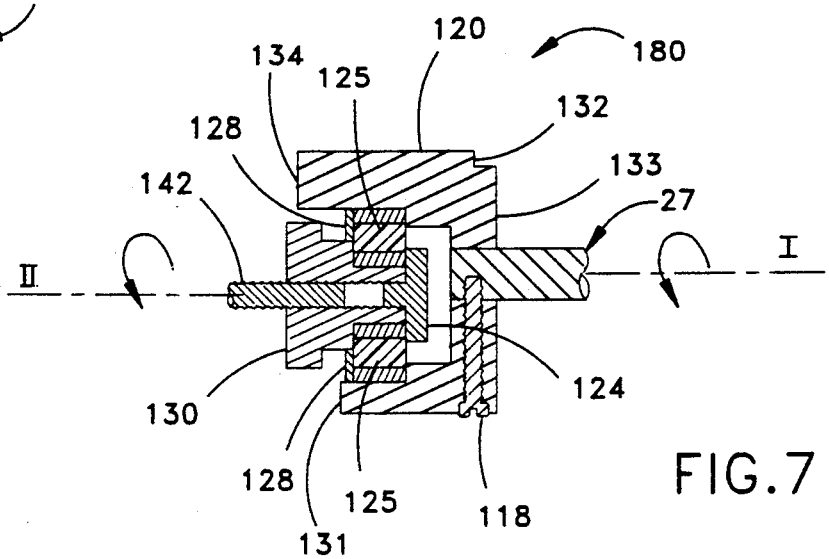
FIG.7
FIG.5
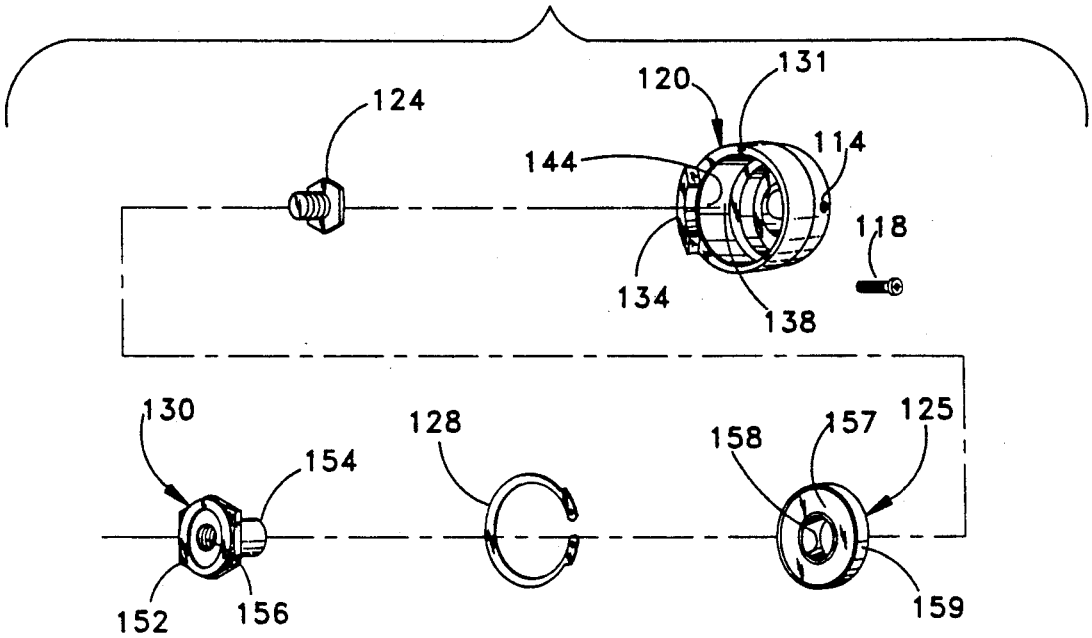

PORTABLE AIR ANGLE HEAD RANDOM ORBITAL UNIT

BACKGROUND OF THE INVENTION

1. Field of the Invention

The present invention relates to rotary pneumatic tools. In particular, the present invention relates to a portable air angle head random orbital unit which can be attached to a polisher, sander or eraser head.

2. Description of the Prior Art

The portable air angle head grinder is one of the most useful tools in manufacturing and service industries. Portable air angle head grinders are most commonly used because of their many advantages such as using pollutionless compressed air as a power source and because they are safe to use. In addition, they require fewer parts, they have a low cost and are easy to maintain. Portable air angle head grinders are often used in work places because of their convenience and flexibility. By modifying the portable air angle head grinder, it can be used in different situations by simply interchanging the grinder head to a polisher, sander or eraser head.

The prior art portable air angle head grinder is designed to have a circular rotation on its grinder head. It will be desirable to modify the portable air angle head grinder to be utilized with a polisher, sander or eraser head and eliminate the standard circular rotation and have a unique random orbital rotation for improved performance.

SUMMARY OF THE INVENTION

The present invention is a portable air head random orbital unit and can function with a utility head such as a polisher, sander or eraser head screwed onto the collet unit. The device can rotate in a random orbital rotation instead of the conventional circular rotation and includes a speed reduction means for reducing the speed of the device from 20,000 revolution per minute (rpm) to 12,000 rpm. The portable air angle head random orbital unit is utilized for repairing small areas on vehicles.

It has been discovered, according to the present invention, that for a portable air angle head random orbit, if the collet unit is modified with a partial flange which is a counter balance weight on the top end of the housing cap and a partial recess on the bottom end of the housing cap, then the collet unit can rotate in a unique random orbital rotation.

It has additionally been discovered, according to the present invention, that improved rotation can be achieved by having the eccentric mounting hole at the bottom end of the collet unit offset from the eccentric opening of the top end of the collet unit to further improve the rotation of the utility head.

It is therefore an object of the present invention to provide a collet unit for the spin unit of a portable air angle head random orbital unit which permits a unique random orbital rotation for improved performance.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention portable air angle head random orbital unit with a polisher head.

FIG. 3 is an exploded view of an angle unit of the portable air angle head random orbital unit.

FIG. 4 is a perspective view of the present invention portable air angle head random orbital unit without an attachment head.

FIG. 5 is an exploded view of the collet unit of the present invention portable air angle head random orbital unit.

FIG. 6 is a back perspective view of the housing cap.

FIG. 7 is a cross-sectional view of the random orbital collet unit.

FIG. 8 is a back perspective view of a sander or eraser head.

DESCRIPTION OF THE PREFERRED EMBODIMENT

Figure 2:
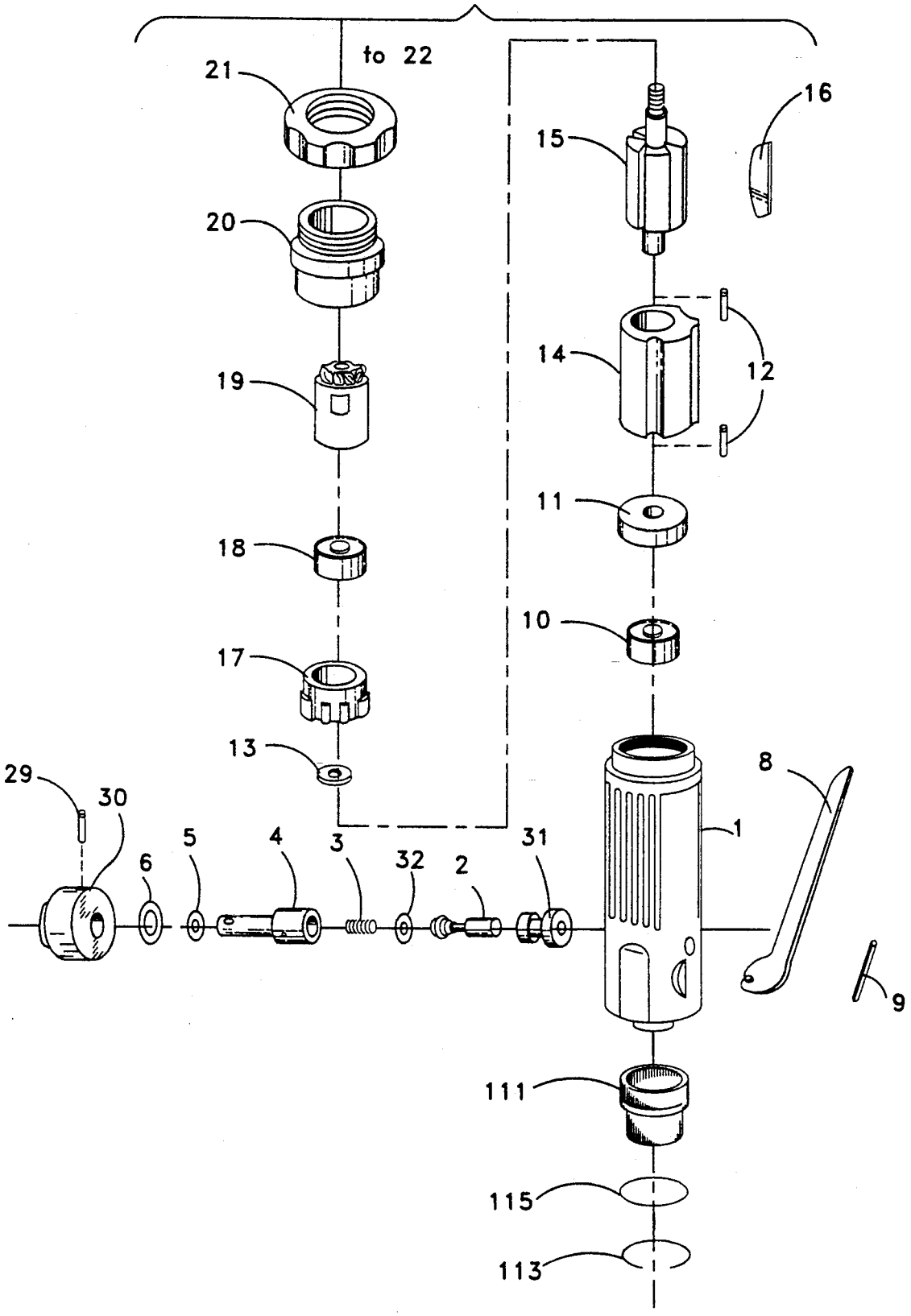
FIG. 2 is an exploded view of a main unit of the portable air angle head random orbital unit.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is shown a perspective view of a portable air angle head random orbital unit. By way of example, this may be a ¼ inch air angle head random orbital unit. It includes a main unit 50 which has an air exhaust port 14, a throttle control unit 60 attached at the bottom end of main unit 50, a speed control regulator knob 30 opposite to the throttle control 60, an angle unit 70 with the straight end connected to the top end of main unit 50, a collet unit 80 connected to the angle end of angle unit 70 and the other end connected to a polisher head 142.

Referring to FIGS. 2, 3 and 4, there is shown the present invention portable air angle head random orbital unit. First there is a hollow cylindrical main housing 1 and an angle housing 22. Near the bottom end of main housing 1 there are two opposite side openings and one bottom opening. An air exhaust sleeve 111 is attached to the bottom opening with an "O" ring 115 and a retainer ring 113 inserted. A throttler unit is assembled inside the main housing 1 near the bottom end through the two side openings. The throttler unit has a throttle valve 2, a spring 3 and an air regulator 4. One end of throttle valve 2 is inserted with spring 3 into the air regulator 4 with an "O" ring 32 inserted, so spring 3 tends to push throttle valve 2 out to block the air passage through air regulator 4. The other end of throttle valve 2 is stuck out from one of the side openings through a valve bushing 31 which is mounted on the side of main housing 1 at the side opening, and the air regulator 4 is assembled inside the main housing 1 and supported with an "O" ring 5 inserted by a speed control regulator knob 30 mounted on the side of main housing 1 at the other opposite side opening with another "O" ring 6 inserted and secured by a roll pin 29. In the conventional way, a valve plug was utilized to control the speed of the portable air angle head. The present invention now utilizes the speed control regulator knob 30 which is now substituted for the valve plug. A throttle lever 8 is attached by a roll pin 9 to the side of main housing 1 near the bottom end against the stuck out end of throttle valve 2. A rotor unit is assembled at the middle portion inside main housing 1. The rotor unit has a cylinder 14, a rotor 15 which has four side slots with blades 16 inserted, a rotor collar 13, two ball bearings 10 and 18, and two end plates 11 and 17. Rotor with rotor collar 13 at the top end is supported by ball bearings 10 and 18, and assembled inside the cylinder 14. The end plates 11 and 17 are assembled to the respective end of cylinder 14 by two roll pins 12 respectively. A pinion 19 is assembled inside main housing 1 near the top end. Pinion 19 has one end mounted to the top end of rotor 15 and the other end stuck out from the top end of main housing 1. A cap lock 20 is screwed at the top end of main housing 1. The straight end of the angle housing 22 is then inserted into the top end of main housing 1 and locked by a cap 21. Therefore, the stuck out end of pinion 19 is now inside angle housing 22. A spin unit is assembled inside angle housing 22. The spin unit includes a ball bearing 23, a gear 24, a bearing 25, a spindle 27 with a key 26, and a clamp nut 28. Gear 24 is mounted on one end of spindle 27 by key 26, and transversely engaged to a pinion so the spindle 27 will spin transversely with respect to the rotor 15. Spindle 27 and gear 24 are supported by ball bearing 23 and assembled inside angle housing 22 with bearing 25. Clamp nut 28 is screwed at the angle end of angle housing 22. An opposite end of the spindle 27 is stuck out from the angle unit 70 for mounting to a collet unit 80. It also includes a small threaded side aperture 112 located on the opposite end of the spindle 27.

Referring to FIGS. 5, 6 and 7, there is shown a collet unit 80 for mounting a utility head such as a polisher, sander or eraser head to a portable air angle head random orbital tool which is assembled outside the opposite end of the spindle 27. The collet unit 80 comprises a generally cylindrical housing cap 120 and includes several novel unique features that makes it different from a conventional housing cap. The housing cap 120 includes a top surface 131 with an eccentric opening 138 and a bottom surface 133 with an eccentric opening 136 offset from the eccentric opening 138 of the top surface 131. The housing cap 120 includes a circumferential sidewall 144. The circumferential sidewall 144 includes a small threaded side aperture 114 which is located at a location adjacent to the bottom surface 133 of the housing cap 120. The opposite end of the spindle 27 is mounted to the eccentric opening 136 of the bottom end 133 of the housing cap 120 by aligning the small threaded side aperture 114 of the circumferential sidewall 144 with the small threaded side aperture 112 of the spindle 27 and thereby securing the housing cap 120 to the spindle 27 by a hex screw 118.

As illustrated in FIGS. 5 and 7, the circumferential sidewall 144 is unbalanced by having a thicker side and a thinner opposite side. Therefore, this is not a conventional sidewall with equal thickness. The thicker side of the circumferential sidewall 144 includes a partial flange 134 which is a counter balance weight, and is located adjacent to the top surface 131 of the housing cap 120, and an opposite partial recess 132 which is adjacent to the bottom surface 133 of the housing cap 120. A bearing 125 or speed reduction means includes an inner ring 158, a middle friction bearing 157 and an outer ring 159 which engages against the sidewall 144 within the eccentric opening 138 of the top surface of the housing cap 120. An extending hollow shank 130 has inner screw threads 156 and further has a first end 154 and a second end 152 configured as a nut. The first end 154 extends through the inner ring 158 of the speed reduction means 125 and is secured thereto by a screw 124. The second end 152 extends out from the eccentric opening 138 of the top surface of the housing cap 120. A retainer ring 128 or retaining means is used for securing the speed reduction means 125 within the eccentric opening 138 of the top surface. Finally, the polisher head 140 with an elongated shaft 142 is screwed into the collet unit 80.

When the random orbital collet unit 80 is assembled, the speed reduction means 125 causes the utility head to rotate at a lower speed than the spindle 27. The spindle 27 rotates about the I-axis and the utility head rotates about the II-axis at a different reduced speed which is caused by the speed reduction means 125. In addition, the unbalance housing cap causes the utility head to rotate in a random orbital rotation.

These features as described above make the collet unit 80 rotate in a random orbital rotation which improves the performance of the portable air angle head random orbital unit. The collet unit 80 can be made from several materials. By way of example, the collet unit 80 can be made of stamped sheet metal.

The collet unit 80 can be utilized with a portable air angle head tool or a portable air head tool. It does not have to be an angle head.

Referring to FIG. 8, there is shown at 146 a sander or eraser head. The sander or eraser head 146 is mounted by screwing the elongated threaded shaft 148 into the second end of the extending hollow shank 130. These utility heads can be utilized with the portable air angle head random orbital unit.

When high pressure compressed air is sent into the bottom end of the main unit 50 and throttle control lever 60 is pressed, the compressed air will be forced into the rotor unit by the throttler unit and blow the blades to make the rotor rotate. The rotor will then drive the spin unit inside the angle unit 70 through the pinion to spin transversely, thereby causing the utility heads such a polisher 140, sander or eraser head 146 to rotate in a random orbital rotation.

By way of example, the housing is cylindrical and is about 3.75 inches in length and about 1.25 inches in outer diameter.

The present invention portable air angle head random orbital unit has many advantages including: (a) it uses convenient and harmless compressed air as its power source; (b) it is a light and small portable device; and (c) it can be used with different types of utility heads such as a polisher, sander or eraser head.

Defined in detail, the present invention is a portable air angle head random orbital unit comprising:

a. a main unit further comprising, (i) a generally cylindrical shaped hollow housing having a top end with a top opening, a bottom end with a bottom opening, a middle portion, a first side opening and an opposite second side opening adjacent to the bottom end, (ii) an air exhaust sleeve mounted to said bottom end of said housing at said bottom opening with a first "O" ring and a first retainer ring inserted, (iii) a throttler unit assembled inside said housing adjacent to its said bottom end including an air regulator, a throttle valve having an inner end and an outer end, and a valve bushing, where the air regulator is supported by a speed control knob with a third "O" ring inserted, which the speed control knob is in turn mounted on said housing at its said first side opening with a second "O" ring inserted and secured by a first roll pin, the inner end of the throttle valve is inserted with a spring into the air regulator with a fourth "O" ring inserted, so that the spring tends to push the throttle valve out to block air passage through the air regulator, and the outer end of the throttle valve extends out from said second side opening of said housing through the valve bushing which is in turn mounted on said housing at its said second side opening, (iv) a throttle lever pivotally mounted to said housing adjacent to its said bottom end by a second roll pin and against the extended outer end of said throttle valve of said throttler unit, such that when the throttle lever is pressed, said throttle valve of said throttler unit is pressed into said air regulator of said throttler unit to permit air passage, (v) a rotor unit assembled inside said middle portion of said housing including a rotor collar and a cylinder having a front end and a rear end, a rotor with four rotor blades, a first ball bearing, a second ball bearing, a front end plate and a rear end plate, where the rotor collar, the rotor and the rotor blades are assembled inside the cylinder and supported by the first and second ball bearings, and the front and rear end plates are attached to the front and rear ends of the cylinder by a third roll pin and a fourth roll pin respectively;

b. an angle unit further comprising, (i) a generally cylindrical shaped angle housing having a straight end and an angled end, a cap lock and a cap where said cap lock is screwed at said top end of said main housing, said straight end of said angle housing is connected to said top end of said main housing by said cap which screws onto said cap lock, (ii) a pinion having one end mounted to said rotor of said rotor unit near said top end of said main housing, and an opposite end extended into said angle housing from said straight end of said angle housing, (iii) a spin unit having a third ball bearing, a gear, a bearing, a clamp nut, a spindle, and a key, the gear engaged to said pinion transversely, one end of the spindle is attached to the gear by the key and supported by the third ball bearing and the bearing which are all assembled inside said angle housing and mounted by the clamp nut, and an opposite end of the spindle is extended out from said angled end of said angle housing;

c. a collet unit further comprising, (i) a generally hollow cylindrical housing cap having a top surface with an eccentric opening, a bottom surface with an eccentric opening offset from the eccentric opening of the top surface, a circumferential sidewall with a small threaded side aperture located adjacent to the bottom surface, and an interior surface, (ii) said circumferential sidewall of said housing cap being unbalanced, and thicker on one side and thinner on an opposite side, (iii) said thicker side of said circumferential sidewall having a partial flange adjacent to said top surface of said housing cap, and an opposite partial recess adjacent to said bottom surface of said housing cap, (iv) a speed reduction bearing having an inner ring, a middle friction bearing and an outer ring engaging against said interior surface of said circumferential sidewall of said housing cap within said eccentric opening of said top surface, (v) an extending hollow shank having inner screw threads, with a first end, and a second end configured as a nut, the first end extending through said inner ring of said speed reduction bearing and secured by a screw, and the second end extending out from said eccentric opening of said top surface of said housing cap, (vi) a second retainer ring for securing said speed reduction bearing within said eccentric opening of said top surface of said housing cap, (vii) an utility head having an elongated threaded shaft threadedly mounted to said second end of said extending hollow shank, and (viii) said spindle mounted to said eccentric opening of said bottom surface of said housing cap by aligning said small threaded side aperture of said circumferential sidewall with said small threaded side aperture of said spindle, such that said spindle can be secured to said housing cap by a hex screw;

d. whereby when said portable air angle head random orbital unit is assembled, said speed reduction bearing causes said utility head to rotate at a lower speed than said spindle, and said offset eccentric openings and said unbalanced housing cap causes said utility head to rotate in a random orbital rotation.

Defined broadly, the present invention is a portable air angle head random orbital unit comprising:

a. a main unit further comprising, (i) a hollow housing having a top end with a top opening, a bottom end with a bottom opening and a middle portion with a first side opening and a second opposite side opening both located adjacent to the bottom end, and an air exhaust sleeve mounted to the bottom end at the bottom opening with a first "O" ring inserted, (ii) a throttler means including an air valve assembled inside said housing adjacent to its said bottom end and a throttle lever pivotally mounted to said housing adjacent to its said bottom end by a second roll pin for regulating air passage, and further including an air regulator, a throttle valve having an inner end and an outer end, and a valve bushing, where the air regulator is supported by a speed control knob with a third "O" ring inserted, which the speed control knob is in turn mounted on said housing at its said first side opening with a second "O" ring inserted and secured by a first roll pin, the inner end of the throttle valve is inserted with a spring into the air regulator with a fourth "O" ring inserted, so that the spring tends to push the throttle valve out to block air passage through the air regulator, and the outer end of the throttle valve extends out from said second side opening of said housing through the valve bushing which is in turn mounted on said housing at its said second side opening, (iii) a rotor means including a rotor rotatably supported by a first pair of ball bearings assembled inside said housing at its said middle portion, and further including a cylinder with two opposite ends and a pair of end plates attached to the two opposite ends of the cylinder by a third roll pin and a fourth roll pin respectively;

b. an angle unit further comprising, (i) an angle housing having a straight end and an angled end, a cap lock and a cap where said cap lock is screwed at said top end of said main housing, said straight end of said angle housing is connected to said top end of said main housing by said cap which screws onto said cap lock and a pinion means having one end mounted to said rotor of said rotor means near said top end of said main housing, and an opposite end extended into the angle housing from the straight end of the angle housing, (ii) a spin means assembled inside said angle housing having a third ball bearing, a gear, a bearing, a clamp nut, a spindle, and a key, the gear engaged to said pinion transversely, one end of the spindle is attached to the gear by the key and supported by the third ball bearing and the bearing, the spin means mounted by the clamp nut, and an opposite end of the spindle is extended out from said angled end of said angle housing; and c. a collet unit further comprising, (i) a hollow housing cap having a top end with an eccentric opening, a bottom end, and a sidewall with a threaded side aperture located adjacent to the bottom end and an interior surface, the sidewall of the hollow housing cap being unbalanced, and thicker on one side and thinner on an opposite side, (ii) said thicker side of said sidewall having a partial flange adjacent to said top end of said hollow housing cap and an opposite partial recess adjacent to said bottom end of said hollow housing cap, (iii) a speed reduction means having an inner ring, a middle friction bearing and an outer ring engaging against said interior surface of said sidewall of said hollow housing cap within said eccentric opening of said top end of said hollow housing cap, (iv) means for securing said speed reduction means within said eccentric opening of said top end of said hollow housing cap, (v) a shank having two opposite ends, one of the two opposite ends extending through said inner ring of said speed reduction means and secured by a fastening means, and the other one of the two opposite ends extending out from said eccentric opening of said top end of said hollow housing cap, (vi) means for mounting an utility head to said shank, and (vii) means for mounting said opposite end of said spindle to said bottom end of said hollow housing cap at a location offset from said utility head;

d. whereby when said portable air angle head random orbital unit is assembled, said speed reduction means causes said utility head to rotate at a lower speed than said spindle, and said eccentric opening and said unbalanced housing cap causes said utility head to rotate in a random orbital rotation.

Defined more broadly, the present invention is a portable air angle head random orbital unit comprising:

a. a main unit further comprising, (i) a housing having a top opening and a bottom opening, (ii) a throttle means, a pinion means and a rotor means assembled inside said housing, the throttle means located adjacent to said bottom end, the pinion means located adjacent to said top end and the rotor means located in between the throttler means and the pinion means;

b. an angle unit further comprising, (i) an angle housing and mounting means for mounting the angle housing to said housing of said main unit, (ii) a spin means assembled inside said angle housing having a spindle and a gear where the gear is engaged to said pinion means transversely and the spindle is attached to the gear; and c. a collet unit further comprising, (i) a hollow housing having an open top end, a bottom end and a sidewall with unbalanced thickness, (ii) a speed reduction means assembled within said hollow housing, (iii) means for interconnecting an utility head to said speed reduction means through said top end of said hollow housing, and (iv) means for securing said spindle to said bottom end of said hollow housing;

d. whereby when said portable air angle head random orbital unit is assembled, said speed reduction means causes said utility head to rotate at a lower speed than said spindle, and said unbalanced hollow housing causes said utility head to rotate in a random orbital rotation.

Defined even more broadly, the present invention is a portable tool comprising: (a) a main unit having a throttler means, a rotor means and a pinion means; (b) an angle unit having a spin means with a spindle and a gear where the gear is engaged to said pinion transversely and the spindle is attached to the gear; (c) a collet unit having a top end with an eccentric opening, a bottom end with an eccentric opening offset from the eccentric opening of the top end, and a sidewall with unbalanced thickness; (d) a speed reduction means assembled within said collet unit; and (e) means for interconnecting an utility head to said speed reduction means through said eccentric opening of said top end of said collet unit, and means for securing said spindle to said eccentric opening of said bottom end of said collet unit; (f) whereby said speed reduction means causes said utility head to rotate at a lower speed than said spindle, and said offset eccentric openings combined with said unbalanced collet unit causes said utility head to rotate in a random orbital rotation.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A portable air angle head random orbital unit comprising:

a. a main unit further comprising, (i) a generally cylindrical shaped hollow housing having a top end with a top opening, a bottom end with a bottom opening, a middle portion, a first side opening and an opposite second side opening adjacent to the bottom end, (ii) an air exhaust sleeve mounted to said bottom end of said housing at said bottom opening with a first "O" ring and a first retainer ring inserted, (iii) a throttler unit assembled inside said housing adjacent to its said bottom end including an air regulator, a throttle valve having an inner end and an outer end, and a valve bushing, where the air regulator is supported by a speed control knob with a third "O" ring inserted, which the speed control knob is in turn mounted on said housing at its said first side opening with a second "O" ring inserted and secured by a first roll pin, the inner end of the throttle valve is inserted with a spring into the air regulator with a fourth "O" ring inserted, so that the spring tends to push the throttle valve out to block air passage through the air regulator, and the outer end of the throttle valve extends out from said second side opening of said housing through the valve bushing which is in turn mounted on said housing at its said second side opening, (iv) a throttle lever pivotally mounted to said housing adjacent to its said bottom end by a second roll pin and against the extended outer end of said throttle valve of said throttler unit, such that when the throttle lever is pressed, said throttle valve of said throttler unit is pressed into said air regulator of said throttler unit to permit air passage, (v) a rotor unit assembled inside said middle portion of said housing including a rotor collar and a cylinder having a front end and a rear end, a rotor with four rotor blades, a first ball bearing, a second ball bearing, a front end plate and a rear end plate, where the rotor collar, the rotor and the rotor blades are assembled inside the cylinder and supported by the first and second ball bearings, and the front and rear end plates are attached to the front and rear ends of the cylinder by a third roll pin and a fourth roll pin respectively;

b. an angle unit further comprising, (i) a generally cylindrical shaped angle housing having a straight end and an angled end, a cap lock and a cap where said cap lock is screwed at said top end of said main housing, said straight end of said angle housing is connected to said top end of said main housing by said cap which screws onto said cap lock, (ii) a pinion having one end mounted to said rotor of said rotor unit near said top end of said main housing, and an opposite end extended into said angle housing from said straight end of said angle housing, (iii) a spin unit having a third ball bearing, a gear, a bearing, a clamp nut, a spindle, and a key, the gear engaged to said pinion transversely, one end of the spindle is attached to the gear by the key and supported by the third ball bearing and the bearing which are all assembled inside said angle housing and mounted by the clamp nut, and an opposite end of the spindle is extended out from said angled end of said angle housing;

c. a collet unit further comprising, (i) a generally hollow cylindrical housing cap having a top surface with an eccentric opening, a bottom surface with an eccentric opening offset from the eccentric opening of the top surface, a circumferential sidewall with a small threaded side aperture located adjacent to the bottom surface, and an interior surface, (ii) said circumferential sidewall of said housing cap being unbalanced, and thicker on one side and thinner on an opposite side, (iii) said thicker side of said circumferential sidewall having a partial flange adjacent to said top surface of said housing cap, and an opposite partial recess adjacent to said bottom surface of said housing cap, (iv) a speed reduction bearing having an inner ring, a middle friction bearing and an outer ring engaging against said interior surface of said circumferential sidewall of said housing cap within said eccentric opening of said top surface, (v) an extending hollow shank having inner screw threads, with a first end, and a second end configured as a nut, the first end extending through said inner ring of said speed reduction bearing and secured by a screw, and the second end extending out from said eccentric opening of said top surface of said housing cap, (vi) a second retainer ring for securing said speed reduction bearing within said eccentric opening of said top surface of said housing cap, (vii) an utility head having an elongated threaded shaft threadedly mounted to said second end of said extending hollow shank, and (viii) said spindle mounted to said eccentric opening of said bottom surface of said housing cap by aligning said small threaded side aperture of said circumferential sidewall with said small threaded side aperture of said spindle, such that said spindle can be secured to said housing cap by a hex screw;

d. whereby when said portable air angle head random orbital unit is assembled, said speed reduction bearing causes said utility head to rotate at a lower sped than said spindle, and said offset eccentric openings and said unbalanced housing cap causes said utility head to rotate in a random orbital rotation.

2. The invention as defined in claim 1 wherein said utility head is a sander head.

3. The invention as defined in claim 1 wherein said utility head is a polisher head.

4. The invention as defined in claim 1 wherein said utility head is an eraser head.

5. A portable air angle head random orbital unit comprising:

a. a main unit further comprising, (i) a hollow housing having a top end with a top opening, a bottom end with a bottom opening and a middle portion with a first side opening and a second opposite side opening both located adjacent to the bottom end, and an air exhaust sleeve mounted to the bottom end at the bottom opening with a first "O" ring inserted, (ii) a throttler means including an air valve assembled inside said housing adjacent to its said bottom end and a throttle lever pivotally mounted to said housing adjacent to its said bottom end by a second roll pin for regulating air passage, and further including an air regulator, a throttle valve having an inner end and an outer end, and a valve bushing, where the air regulator is supported by a speed control knob with a third "O" ring inserted, which the speed control knob is in turn mounted on said housing at its said first side opening with a second "O" ring inserted and secured by a first roll pin, the inner end of the throttle valve is inserted with a spring into the air regulator with a fourth "O" ring inserted, so that the spring tends to push the throttle valve out to block air passage through the air regulator, and the outer end of the throttle valve extends out from said second side opening of said housing through the valve bushing which is in turn mounted on said housing at its said second side opening, (iii) a rotor means including a rotor rotatably supported by a first pair of ball bearings assembled inside said housing at its said middle portion, and further including a cylinder with two opposite ends and a pair of end plates attached to the two opposite ends of the cylinder by a third roll pin and a fourth roll pin respectively;

b. an angle unit further comprising, (i) an angle housing having a straight end and an angled end, a cap lock and a cap where said cap lock is screwed at said top end of said main housing, said straight end of said angle housing is connected to said top end of said main housing by said cap which screws onto said cap lock and a pinion means having one end mounted to said rotor of said rotor means near said top end of said main housing, and an opposite end extended into the angle housing from the straight end of the angle housing, (ii) a spin means assembled inside said angle housing having a third ball bearing, a gear, a bearing, a clamp nut, a spindle, and a key, the gear engaged to said pinion transversely, one end of the spindle is attached to the gear by the key and supported by the third ball bearing and the bearing, the spin means mounted by the clamp nut, and an opposite end of the spindle is extended out from said angled end of said angle housing;

c. a collet unit further comprising, (i) a hollow housing cap having a top end with an eccentric opening, a bottom end, and a sidewall with a threaded side aperture located adjacent to the bottom end and an interior surface, the sidewall of the hollow housing cap being unbalanced, and thicker on one side and thinner on an opposite side, (ii) said thicker side of said sidewall having a partial flange adjacent to said top end of said hollow housing cap and an opposite partial recess adjacent to said bottom end of said hollow housing cap, (iii) a speed reduction means having an inner ring, a middle friction bearing and an outer ring engaging against said interior surface of said sidewall of said hollow housing cap within said eccentric opening of said top end of said hollow housing cap, (iv) means for securing said speed reduction means within said eccentric opening of said top end of said hollow housing cap, (v) a shank having two opposite ends, one of the two opposite ends extending through said inner ring of said speed reduction means and secured by a fastening means, and the other one of the two opposite ends extending out from said eccentric opening of said top end of said hollow housing cap, (vi) means for mounting an utility head to said shank, and (vii) means for mounting said opposite end of said spindle to said bottom end of said hollow housing cap at a location offset from said utility head;

d. whereby when said portable air angle head random orbital unit is assembled, said speed reduction means causes said utility head to rotate at a lower speed than said spindle, and said eccentric opening and said unbalanced housing cap causes said utility head to rotate in a random orbital rotation.

6. The invention as defined in claim 5 wherein said utility head is a sander head.

7. The invention as defined in claim 5 wherein said utility head is a polisher head.

8. The invention as defined in claim 5 wherein said utility head is an eraser head.

9. The invention as defined in claim 5 wherein said means for securing said speed reduction means within said eccentric opening of said top end of said hollow housing cap is a retainer ring.

10. The invention as defined in claim 5 wherein said fastening means is a screw.

11. The invention as defined in claim 5 wherein said means for mounting said utility head to said shank is by inner threads in said shank.

12. The invention as defined in claim 5 wherein said means for mounting said opposite end of said spindle to said bottom end of said hollow housing cap includes a hex screw.

13. A portable air angle head random orbital unit comprising:

a. a main unit further comprising, (i) a housing having a top opening and a bottom opening, (ii) a throttler means, a pinion means and a rotor means assembled inside said housing, the throttler means located adjacent to said bottom end, the pinion means located adjacent to said top end and the rotor means located in between the throttler means and the pinion means;

b. an angle unit further comprising, (i) an angle housing and mounting means for mounting the angle housing to said housing of said main unit, (ii) a spin means assembled inside said angle housing having a spindle and a gear where the gear is engaged to said pinion means transversely and the spindle is attached to the gear; and c. a collet unit further comprising, (i) a hollow housing having an open top end, a bottom end and a sidewall with unbalanced thickness, (ii) a speed reduction means assembled within said hollow housing, (iii) means for interconnecting an utility head to said speed reduction means through said top end of said hollow housing, and (iv) means for securing said spindle to said bottom end of said hollow housing;

d. whereby when said portable air angle head random orbital unit is assembled, said speed reduction means causes said utility head to rotate at a lower speed than said spindle, and said unbalanced hollow housing causes said utility head to rotate in a random orbital rotation.

14. The invention as defined in claim 13 wherein said utility head is a sander.

15. The invention as defined in claim 13 wherein said utility head is a polisher.

16. The invention as defined in claim 13 wherein said utility head is an eraser.

17. The invention as defined in claim 13 wherein said sidewall of said hollow housing being thicker on one side and thinner on an opposite side, and said sidewall having a partial flange adjacent to said top end of said hollow housing and an opposite partial recess adjacent to said bottom end of said hollow housing.

18. The invention as defined in claim 13 wherein said speed reduction means includes an inner ring, a middle friction bearing and an outer ring.

19. The invention as defined in claim 13 wherein said means for interconnecting said utility head to said speed reduction means through said top end of said hollow housing includes an extended shank.

20. The invention as defined in claim 13 wherein said means for securing said spindle to said bottom end of said hollow housing includes a hex screw.

21. The invention as defined in claim 13 further comprising a retainer ring for securing said speed reduction means within said hollow housing.

22. A portable tool comprising:

a. a main unit having a throttler means, a rotor means and a pinion means;

b. an angle unit having a spin means with a spindle and a gear where the gear is engaged to said pinion transversely and the spindle is attached to the gear;

c. a collet unit having a top end with an eccentric opening, a bottom end with an eccentric opening offset from the eccentric opening of the top end, and a sidewall with unbalanced thickness;

d. a speed reduction means assembled within said collet unit; and e. means for interconnecting an utility head to said speed reduction means through said eccentric opening of said top end of said collet unit, and means for securing said spindle to said eccentric opening of said bottom end of said collet unit;

f. whereby said speed reduction means causes said utility head to rotate at a lower speed than said spindle, and said offset eccentric openings combined with said unbalanced collet unit causes said utility head to rotate in a random orbital rotation.

23. The invention as defined in claim 22 wherein said utility head is a sander.

24. The invention as defined in claim 22 wherein said utility head is a polisher.

25. The invention as defined in claim 22 wherein said utility head is an eraser.

26. The invention as defined in claim 22 wherein said sidewall of said collet unit being thicker on one side and thinner on an opposite side, and said sidewall having a partial flange adjacent to said top end of said collet unit and an opposite partial recess adjacent to said bottom end of said collet unit.

27. The invention as defined in claim 22 wherein said speed reduction means includes an inner ring, a middle friction bearing and an outer ring.

28. The invention as defined in claim 22 wherein said means for interconnecting said utility head to said speed reduction means through said eccentric opening of said top end of said hollow housing cap includes an extended shank.

29. The invention as defined in claim 22 wherein said means for securing said spindle to said eccentric opening of said bottom end of said hollow housing cap includes a hex screw.

* * * * *